US005924309A

United States Patent [19]

Conti

[11] Patent Number: 5,924,309

[45] Date of Patent: Jul. 20, 1999

[54] RIBBED SOCK TOE CLOSING METHOD AND APPARATUS ON DOUBLE-CYLINDER KNITTING MACHINE

[75] Inventor: Paolo Conti, Florence, Italy

[73] Assignee: Golden Lady S.p.A., Ancona, Italy

[21] Appl. No.: 08/894,992

[22] PCT Filed: Jan. 27, 1997

[86] PCT No.: PCT/IT97/00019

§ 371 Date: Aug. 15, 1997

§ 102(e) Date: Aug. 15, 1997

[87] PCT Pub. No.: WO97/28300

PCT Pub. Date: Aug. 7, 1997

[30] Foreign Application Priority Data

Jan. 31, 1996 [WO] WIPO ..... FI96/A/000013

[51] Int. Cl.[6] ..... D04B 9/56

[52] U.S. Cl. ..... 66/58; 66/148; 66/149 S; 66/18

[58] Field of Search ..... 66/148, 58, 149 S, 66/18

[56] References Cited

U.S. PATENT DOCUMENTS

| | | | |
|---|---|---|---|
| 1,554,248 | 9/1925 | Williams | 66/18 |
| 4,122,690 | 10/1978 | Moreni | 66/58 |
| 5,211,035 | 5/1993 | Hanson, II | 66/51 |
| 5,231,856 | 8/1993 | Lonati et al. | 66/149 S |
| 5,570,591 | 11/1996 | Frullini et al. | 66/148 |
| 5,617,744 | 4/1997 | Conti | 66/148 |

FOREIGN PATENT DOCUMENTS

| | | |
|---|---|---|
| 0 592 376 A1 | 4/1994 | European Pat. Off. . |
| 1 635 992 | 7/1971 | Germany . |
| FI94A00088 | 5/1994 | Italy . |
| FI94A000125 | 6/1994 | Italy . |
| WO 95/31595 | 11/1995 | WIPO . |
| WO 95/34702 | 12/1995 | WIPO . |
| WO 96/37649 | 11/1996 | WIPO . |

*Primary Examiner*—Andy Falik

*Attorney, Agent, or Firm*—McGlew and Tuttle, P.C.

[57] ABSTRACT

A sock or other tubular article with one closed end and with rib fabric—that is, with face and reverse stitches—is formed in a double-cylinder circular machine (1, 3), in which the toe is closed at the end of the process of forming the tubular fabric, by a device (41, 51, 53, 49) that transfers the stitches of one semicircle to the stitches of the opposite semicircle.

9 Claims, 13 Drawing Sheets

RIBBED SOCK TOE CLOSING METHOD AND APPARATUS ON DOUBLE-CYLINDER KNITTING MACHINE

FIELD OF THE INVENTION

The object of the invention is to produce a sock or other tubular article with rib stitches and with one end closed directly on the machine that produces the article.

BACKGROUND OF THE INVENTION

These tubular articles are usually made on so-called double-cylinder machines, that is machines having two opposing coaxial cylinders with symmetrical and transferable needles that can be engaged alternately by the so-called sliders of first one then the other cylinder, thereby forming "rib" fabric, that is, fabric with face and reverse stitches for at least a cuff or the like.

SUMMARY AND OBJECTS OF THE INVENTION

It is a primary object of the present invention to have the same machine close one end of the article, such as the toe of a stocking or sock, thus avoiding the need for operations to be performed after the tubular structure has been finished.

A first subject of the invention is a method for forming a tubular article with a closed end and with rib fabric (face and reverse) at least for the edge or cuff at the opposite end to the closed end, in a circular machine with two needle beds and in particular with two cylinders. The toe is closed at the end of the process of forming the tubular fabric, by transferring the fabric formed by the needles of one semicircle to, and engaging it on, the needles of the opposite semicircle.

Advantageously, the article being formed is tensioned upwards around a temporarily inactive pneumatic transport duct, and is folded inside out and hence upside down in said pneumatic transport duct after the toe has been closed.

In one possible embodiment, the end of the fabric to be transferred to and engaged on the needles of the opposite semicircle is formed with an elastic yarn present, which yarn arranges the to be transferred fabric diametrically with respect to the needle cylinder when this fabric is released by the needles of the first of said semicircles; the transfer fabric is then progressively brought towards and engaged on the needles of the opposite semicircle.

Another subject of the invention is a double-cylinder type circular knitting machine, with needles that can be transferred from one cylinder to the other and with sliders that can be slid in each cylinder to operate the needles. According to the invention, the machine comprises means for transferring—at the end of the process of forming the tubular article—the end fabric formed by one semicircle of needles to the needles of the opposite semicircle, and means for operating the needles of said opposite semicircle to engage the fabric when this is transferred to them.

The present machine advantageously comprises: an additional yarn feeder guide for an elastic yarn, actuated to feed said elastic yarn to at least the needles of the semicircle of needles forming the fabric that is to be transferred, whose final stitches may also be formed with elastic yarn; means—that do not move with the revolving cylinders—for bringing said final stitches progressively towards the needles of the opposite semicircle; and pushers capable of further pushing the already transferred fabric, in a centrifugal direction until it intercepts the path of the needles of the opposite semicircle, activated at the right moment to pass across the end portion of said transferred fabric.

More particularly, the machine may comprise, inside one of the cylinders, a mechanism that does not move with the revolving cylinders and that possesses a shaped plate which, as the cylinders revolve, progressively pushes the transfer fabric over to the semicircle of needles that are to engage said transfer fabric, and that also possesses two radial pushers and means for reciprocating them, in order to progressively move the transfer fabric centrifugally and engage the transfer fabric on the needles of the other semicircle, which are still carrying the loops that they themselves have formed.

Other known solutions may also be used for the transfer.

In one advantageous embodiment, the machine comprises a pneumatic transport duct coaxial with one of the cylinders for pneumatic removal of the article, and comprises a second or pneumatic tensioning duct of annular section arranged around said transport duct; also provided are means for turning on suction means connected to said second pneumatic duct in order to tension the article during its formation, and means for stopping the suction through the second pneumatic duct and starting the suction in the pneumatic transport duct in order to turn the completed article upside down, that is, inside out, and remove it.

A clearer understanding of the invention will be obtained from the description and accompanying drawing, the latter showing a practical non-restrictive example of the invention.

DESCRIPTION OF THE PREFERRED EMBODIMENT

Figure 1:
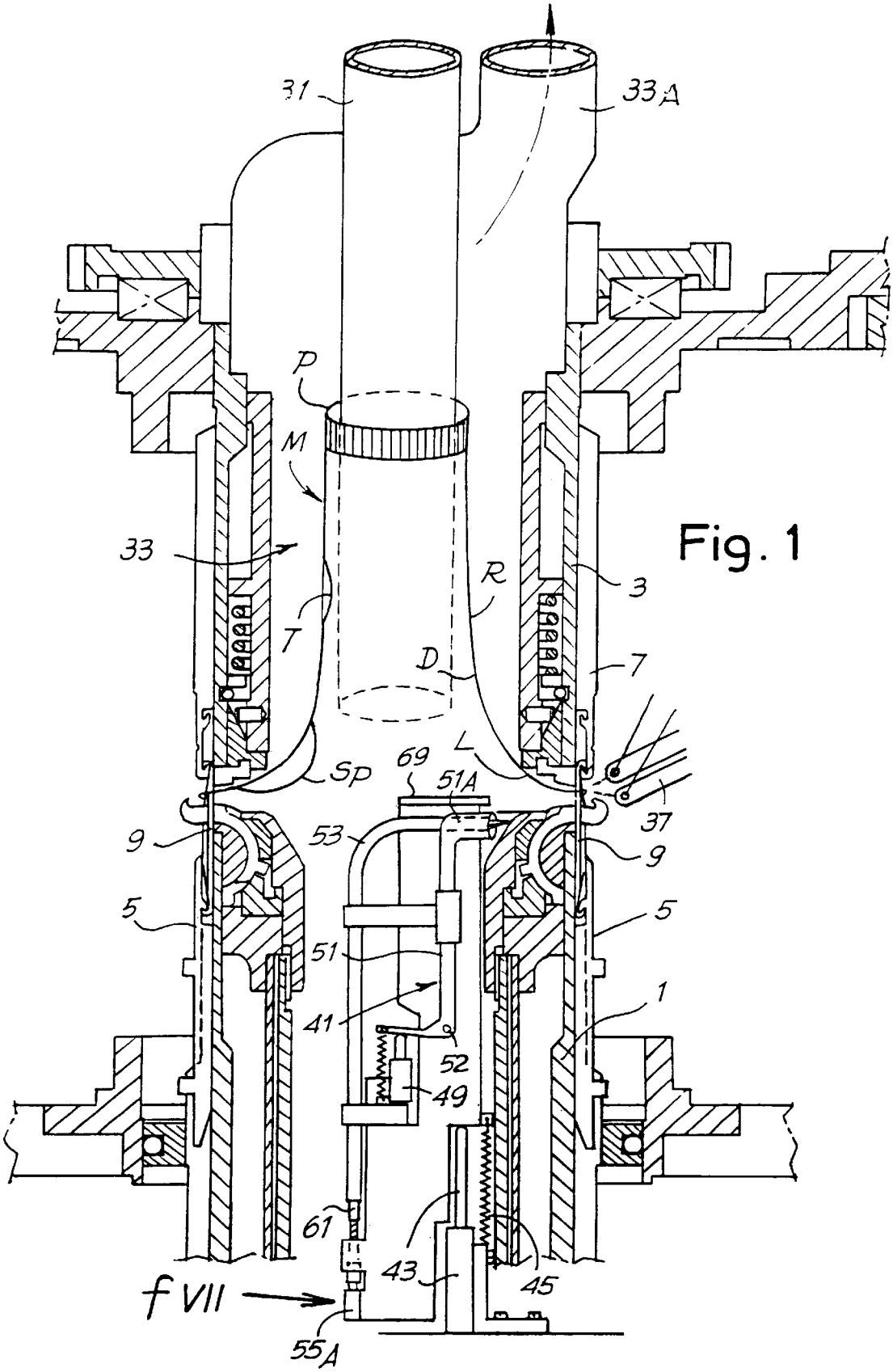
FIGS. 1, 2 and 3 are partial schematic vertical sections, in different dimensions, of a double-cylinder circular machine with additional parts in accordance with the invention and shown positioned in three different stages.
Figure 2:
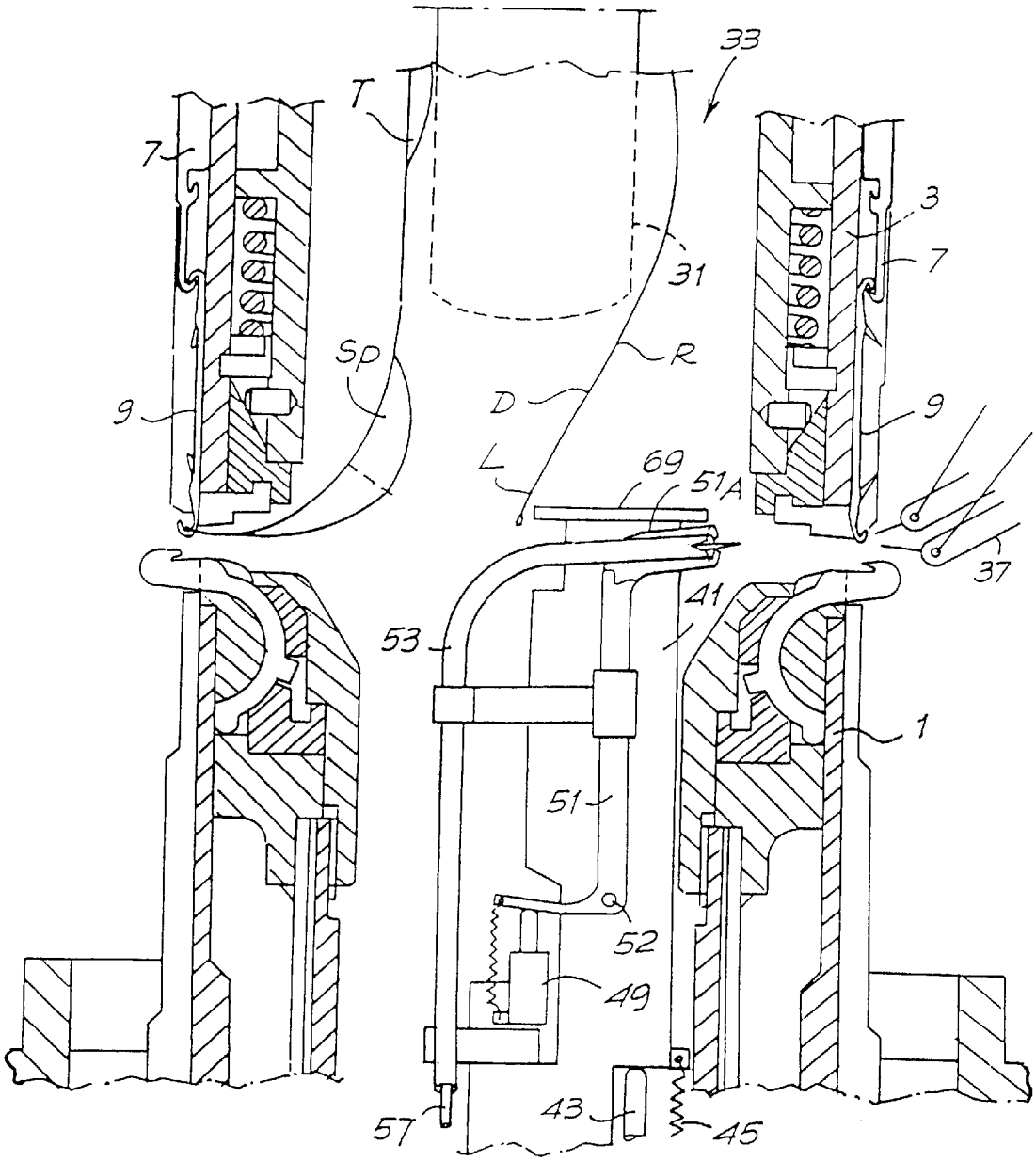
Figure 3:
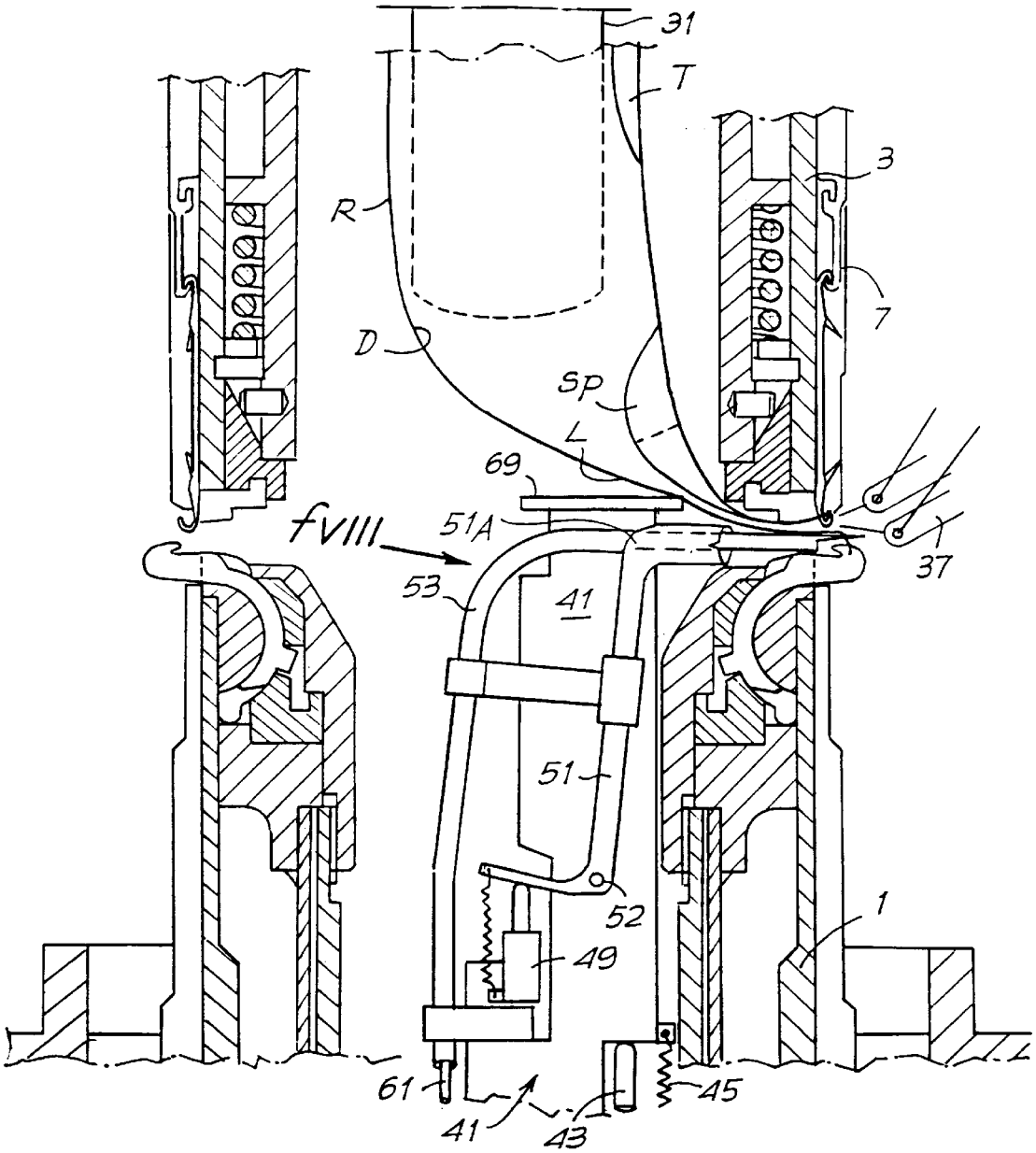
Figure 4:
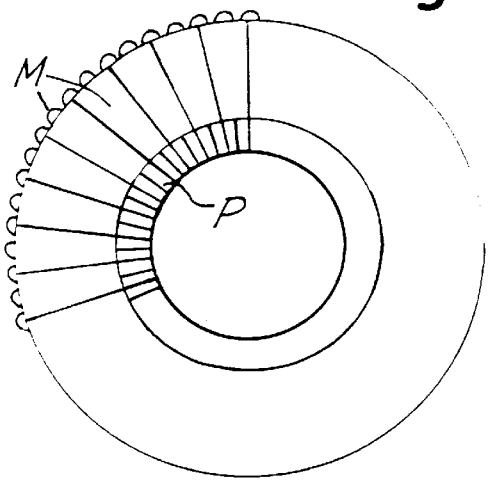
FIGS. 4, 5 and 6 are a veiw of the position of the fabric as it is formed, in an illustrative cross section, in the various stages shown in FIGS. 1, 2 and 3.

In the drawing, with particular reference to FIGS. 1 to 3, the double-cylinder circular machine is illustrated schematically. In particular, 1 is the bottom cylinder, 3 the top cylinder, 5—in some of these figures and in other figures of the drawings sketches in the sliders of the bottom cylinder, 7 the sliders of the top cylinder, and 9 the symmetrical double-ended needles which can be hooked and operated alternately by the sliders 5 and the sliders 7 to form the fabric with face and reverse stitches, i.e. rib fabric, which is characteristic of the output of double-cylinder circular-machines. Other parts of the conventional double-cylinder machine, known in themselves, are also illustrated.

Mounted inside the top cylinder 3 is a pneumatic transport duct 31 for removing—in the manner indicated below—the finished article; this duct extends down to just above the working area of the needles between the two opposing cylinders. A second or pneumatic tensioning duct is provided in the space 33 around the duct 31 (FIGS. 1 to 3), has an annular cross section extending around the duct 31 and is connected to a suction pipe 33A which is intended to be turned on for the pneumatic tensioning of the article being formed, optionally in combination with other tensioning means of mechanical type (not shown). Specific suction means may be provided for the pneumatic transport duct 31 and others for the second or pneumatic tensioning duct 33, 33A, for alternative actuation; as a variant, a single suction unit may be used capable of switching between the two ducts 31 and 33, 33A, for the purposes indicated later.

With the double-cylinder circular machine illustrated and described in outline, and working in a conventional manner, and with the pneumatic tensioning system represented by the second or pneumatic tensioning duct 33 or in some equivalent way, it is possible to form a tubular article with face and reverse stitches, i.e. a rib structure, for at least a part of this article, such as a stocking or sock. This article is denoted as a whole by the letter M and comprises (in accordance with the illustration) a socalled cuff P, the main part M of the tubular fabric, a lateral pouch T for the heel and a pouch SP for the toe. After its formation, in the conventional machine the article is released by the needles and removed, i.e. by pneumatic means and its toe is then closed in a separate operation.

The machine according to the invention is improved so that toe closure is performed directly on the machine itself, as described below.

It can be seen that as the article M is being formed with heel pouch T and toe pouch SP, suction is being applied upwards through the space 33 of the tension duct, the reverse side R being on the outside and the face surface D on the inside. The letter L indicates the end portion which is diametrically opposite the side where the heel pouch T and toe pouch SP are formed. The article being formed is drawn upwards into the top cylinder 3 around the duct 31, being tensioned by the stream of air sucked by the duct 33A, 33.

Figure 16:
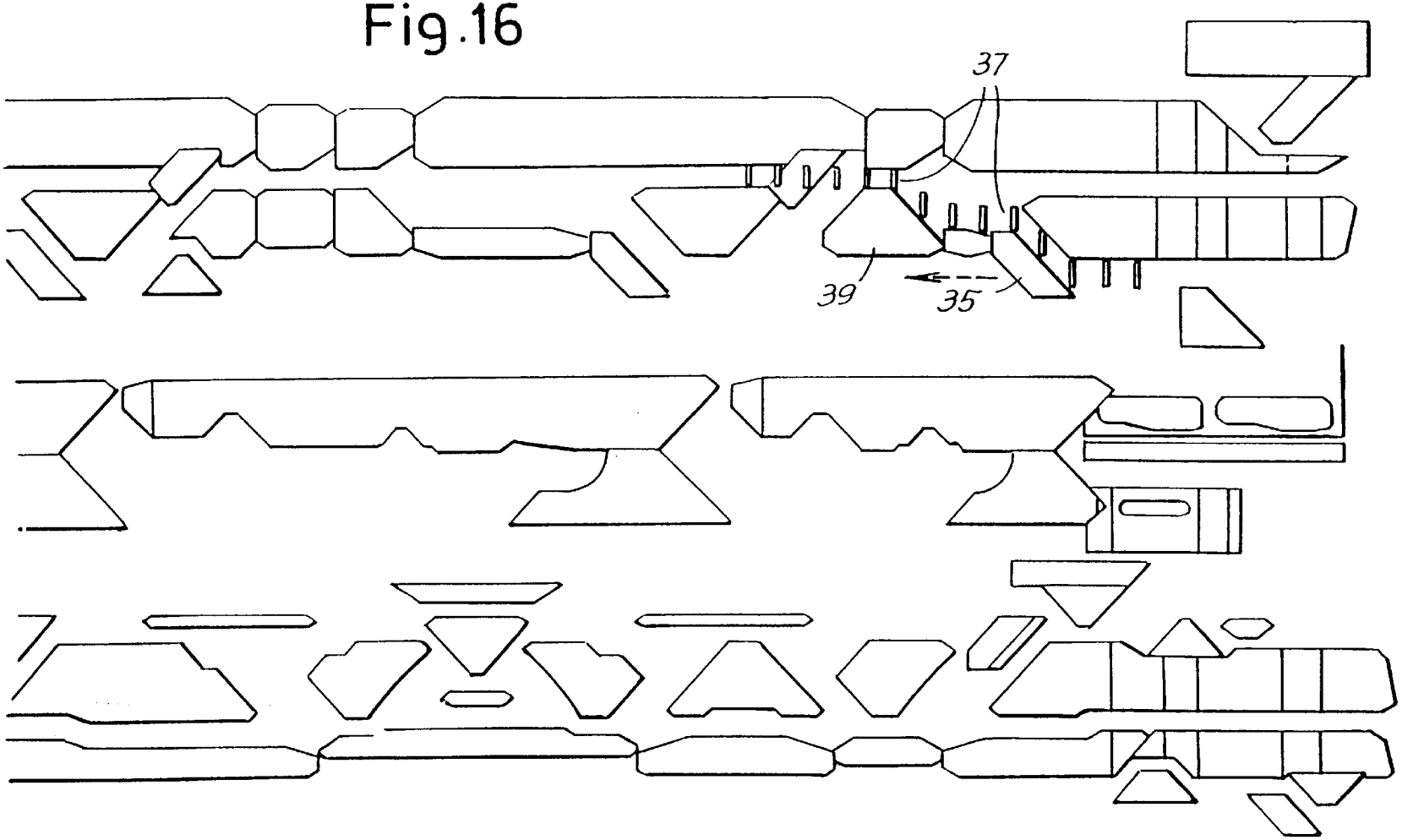
FIG. 16 is a veiw of a part of the development of a cam box for controlling the so-called sliders of the opposing cylinders of the machine.
Figure 17:
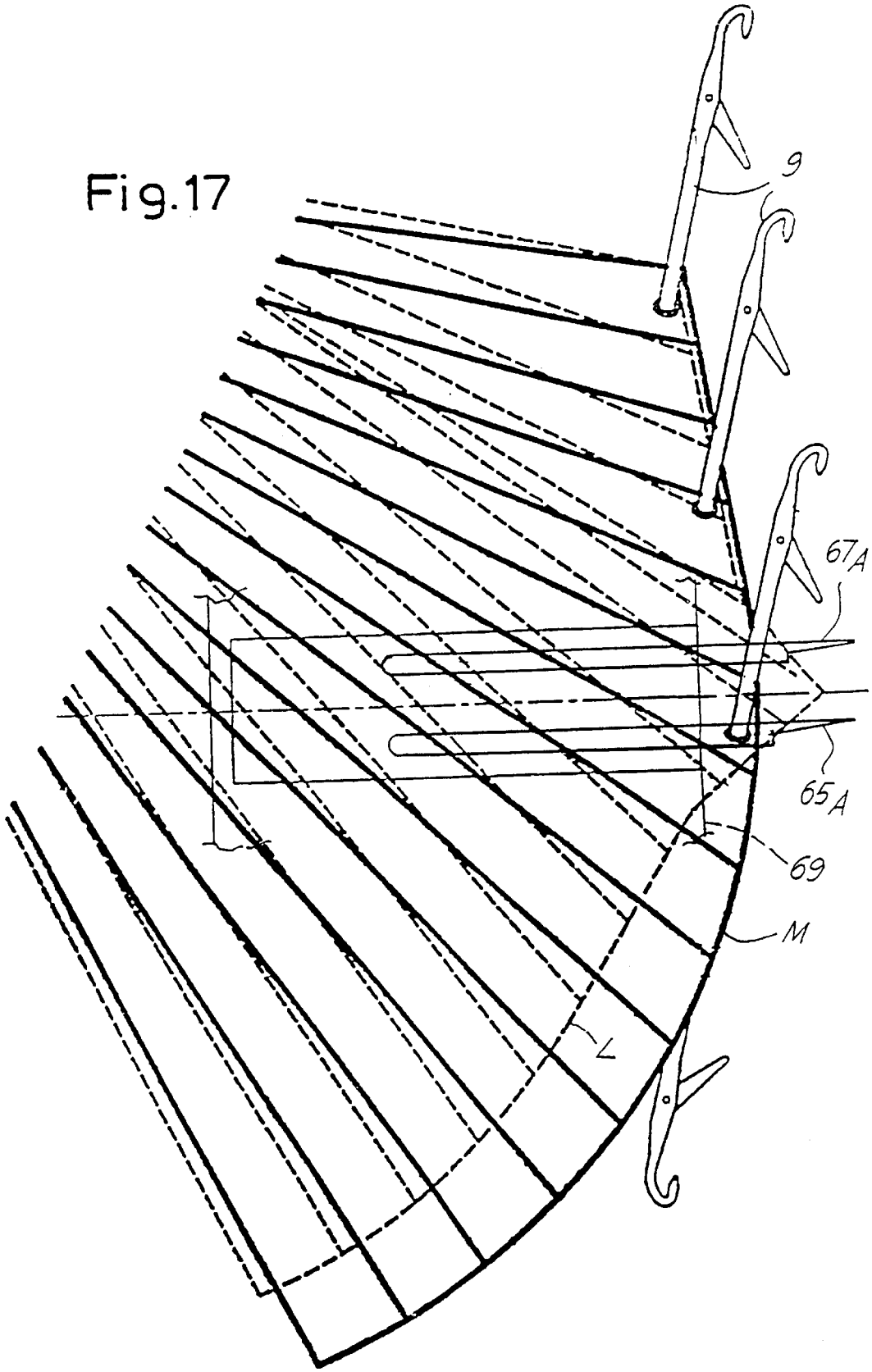
FIG. 17 is a highly schematic perspective detail to illustrate the joining together of the fabric end portions to form the closed toe.

When the toe pouch SP has been finished, all the needles 9 are usually hooked on the sliders 5 of the bottom cylinder 1 as is indicated-in FIG. 1. In this condition of the article the toe must be closed in the manner indicated below using a device that is housed within the bottom cylinder 1, said device working in combination with the actuation of the needles 9 of the machine and with the respective control systems of the sliders 5 and 7, with the cam box which is outlined in FIG. 16. One of the cams of this box, which are essentially conventional cams, is pointed out in particular, as being useful for the subsequent explanation, is cam 35 for lifting the butts of the sliders into a track 37. During which the butts of the sliders 7 of the top cylinder 3 are raised by the stitch cam 39. This layout is suitable for producing a selection of only some of the needles and in particular of those of the semicircle of needles intended to form the end portion L, which must be cast off the needles so as to be transferred and joined to the diametrically opposite side of the article, which is the side where the pouches T and SP were formed.

In addition to the normal yarn feeder guides for forming the article, a special yarn feeder guide 37 is added for an elastic yarn which must be used -in order to bring about the closure of the toe at the opposite end from the cuff P.

The device which is to cooperate in forming the toe closure, and is housed in the cylinder 1, comprises a closure mechanism bearing the general reference 41, which is guided parallel with the axis of the cylinders 1 and 3 and can be lifted by an actuator 43 against the action of an opposing spring 45 or in some other suitable way; said mechanism does not move with the cylinders as they revolve. On this mechanism 41 is an actuator 49 that acts on a part 51 capable of pivoting about a pin 52 under the action of this actuator 49 and against the action of opposing elastic means. The upper end 51A of the part 51 is bent, as can be seen in particular in FIG. 8, where the part 51 is shown partly torn away at the top to reveal the components inside it; the rim 51B of said part 51 is given two triangular notches on opposite sides. Within the upper bent portion 51A of the part 51 (which can pivot about the hinge 52) there extends a flexible tubular guiding sheath marked 53 that runs down and ends near a pair of actuators 55A and SSB (see in particular FIGS. 1 to 3 and FIG. 7) whose purpose is to operate against the action of opposing means, two flexible rods 57 and 59 sliding inside sheaths 61 and 63 housed inside the flexible tubular sheath 53; at their ends housed in the extremity 51A of the part 51, the two flexible rods 57, 59 comprise expansions 65, 67 forming abutments 65B and 67B, and beyond these they develop pins or points 65A, 67A, respectively, projecting approximately radially relative to the cylinders; these expansions 65, 67 act as two pushers. Also integral with the mechanism 41 is a shaped metal plate 69 that can be seen in plan view particularly in FIGS. 5 and 6; this plate 69 is symmetrically shaped with respect to the mechanism 41 and has two shaped edges 69A for reasons indicated below. The two actuators 55A, 55B that act on the flexible rods 57 and 59, and hence on the two pins or points 65A and 67A, act on said rods and hence on said points alternately in such a way that one of these points is pushed out while the other is withdrawn, and vice versa in alternation, also for the reasons indicated below. The actuator 49 acts on the part 51 in such a way as to move it from the position shown in FIGS. 1 and 2 to that shown in FIG. 3, in which the end 51A of the part 51 with the sheath 53, the flexible rods 57, 59 and the points 65A and 67A moves from an inward position to a position of projection towards the working area of the needles 9. The actuator 43 is responsible for lifting the mechanism 41 at the right moment—and before the end 51A of the part 51 has moved in the centrifugal direction—from the position shown in FIG. 1 to that shown in FIG. 2, after which the end 51A of the part 51 makes a centrifugal movement, as can be seen by comparing FIG. 2 and FIG. 3. It will be recalled that the mechanism 41 with items connected to it does not participate in the rotation of the cylinders.

Having briefly described the components of the machine and those of the added devices, a description will now be given of how the machine operates in such a way that the article is processed all the way to terminating the article by closing the toe.

The stocking or other article M is produced in the conventional way on the double-cylinder machine commencing with the cuff P and continuing until the heel pouch T and toe pouch SP have been completed. The article M fits around the duct 31 for the ordinary growth of the initial part P of the article, and is then sucked up the upper cylinder 33 with its reverse side R outermost and its face side D innermost; the completed article is—apart from its length, which is reduced owing to the requirements of the drawing—as is visible in FIG. 1, formed around the duct 31 and inside the space 33 forming the annular-sectioned tensioning duct. The partial vacuum in the duct 33 (optionally in combination with mechanical means, not illustrated) serves to give the article the tension which is necessary during formation in rib-producing machines. In this stage the duct 31 is inactive. When the toe pouch SP is finished, all the needles 9 will normally be hooked on the sliders 7 in the bottom cylinder 3 (FIG. 1).

According to the invention, at this point a number of partial courses RE (FIGS. 5 and 6) of stitches are formed with an elastic yarn FE fed by the yarn feeder guide 37; these partial courses RE are formed only over the instep of the foot and produced with reciprocating motion of the cylinder on the opposite side from the pouch fabric SP. Next, all the needles 9 are transferred to the top cylinder 3 with at least one complete revolution of the cylinders. At this stage, only the needles of the semicircle corresponding to the instep of the foot (to which the elastic yarn FE has previously been fed) are raised by the cam 35 (FIG. 16) and sent into the track 37 so as to rise up the stitch cam 39. In the feed corresponding to this stitch cam 39, no yarn is supplied, so that the needles 9 in question—of the semicircle opposite the toe pouch SP—after casting off their loops, remain empty and the fabric of the end portion L corresponding to these needles is released to give a free end portion (FIG. 2). As a result, the abovementioned fabric L, which corresponds to that of the half cylinder opposite the pouch SP, arranges itself—in plan view—as in FIG. 5. The reason for this is that the fabric L, which includes the partial courses RE of elastic yarn, arranges itself along a diametrical chord immediately on being released by the needles because, having been produced with elastic yarn in the last courses, it tends to contract.

In the next operation the mechanism 41 is raised with the composite assembly of parts 49, 51, 53, 55, 55A, 69 to the level shown in FIG. 2, with the plate 69 above the fabric, the fabric engaged by the needles 9, and the needles 9 transferred to the top cylinder 3, and hence above the end portion L which is finished with the elastic courses RE.

Figure 5:
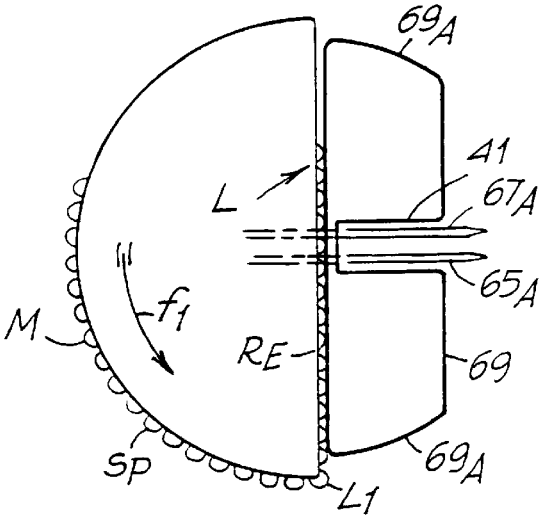
Figure 6:
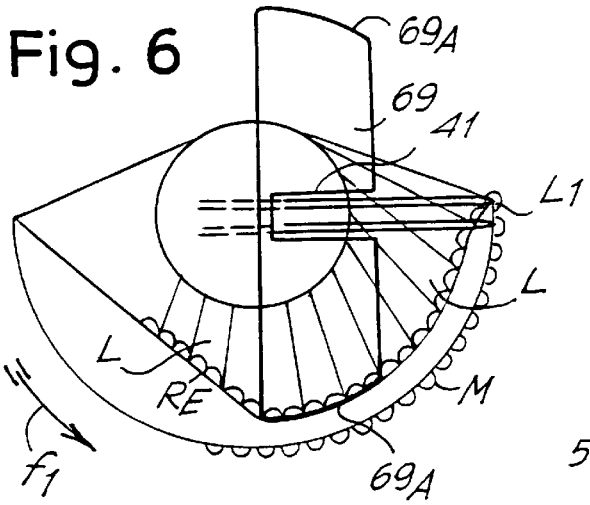

The shaped metal plate 69—which in plan view has the shape shown in FIGS. 5 and 6—has the function of pushing out, with its edge 69A, the end fabric L released by the needles (which initially is on the chord as indicated by RE in FIG. 5) and bringing it gradually towards the needles of the opposite semicircle to that from which said fabric L has come, when the cylinders 1 and 3 rotate in the direction f1 (FIGS. 5 and 6) relative to said plate 69. The effect produced is that visible in FIG. 6 and in FIG. 9, which show the cylinder rotated by 90° with respect to FIG. 5 in the direction of arrow f1 and the edge 69A which has brought part of the course RE of the free fabric L against the ring of needles.

Figure 7:
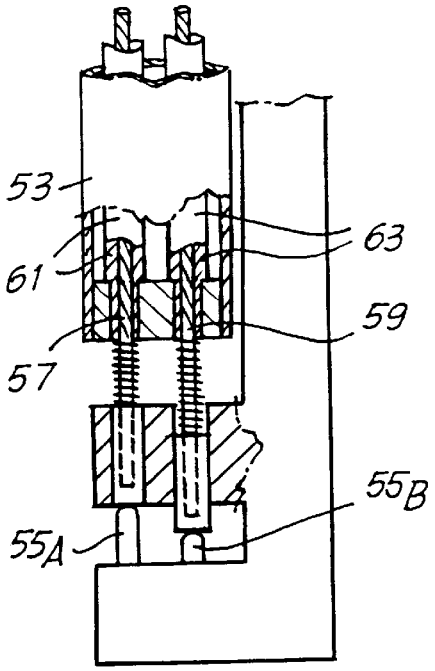
FIG. 7 is an enlarged detail of a device for actuating additional parts indicated by the arrow fVII in FIG. 1.
Figure 8:
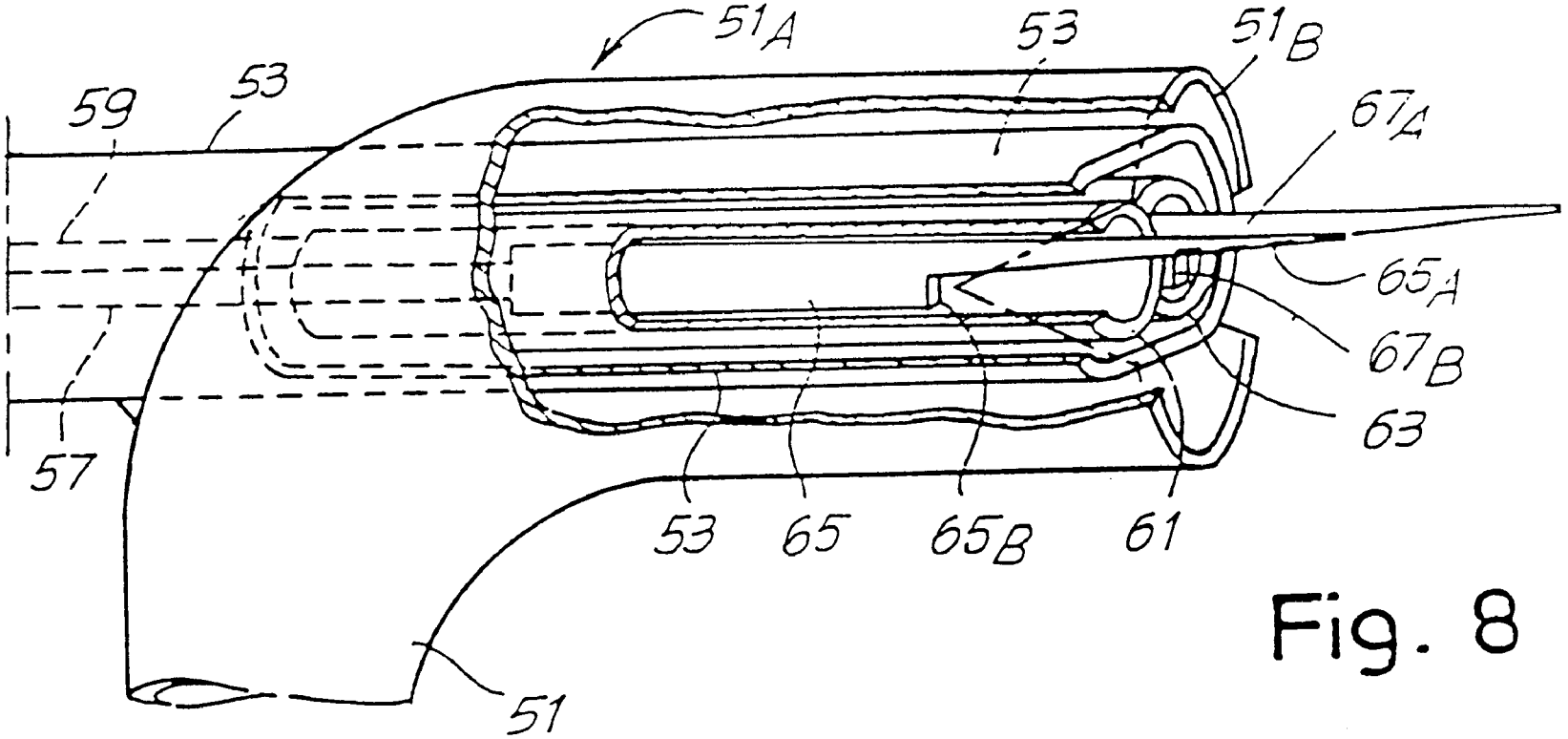
FIG. 8 is a detail veiw indicated by the arrow fVIII in FIG. 3, greatly enlarged, schematically and partly in section.

It is at this point that the assembly supported by the mechanism 41 immediately below the plate 69 comes into action. This assembly comprises the flexible tubular part 53 containing, in turn, the two flexible elements 57, 59 with the sharp points 65A, 67A that can emerge on command from the mouth 51B of the extremity 51A of the part 51, under the control of the pistons of the actuators 55A, 55B (FIGS. 3 and 7).

The extremity 51A of the tubular part 51 is moved from its inward position in FIG. 2 to that shown in FIG. 3 where it is closer to the ring of needles 9, precisely when the cylinder is in the position of FIG. 6.

The alternating action of the elements 65, 67 now commences: these are shaped at their ends (FIG. 8) into pins or points 65A, 67A. These points penetrate the end portion L of the fabric, which rests against- the abutments 65B, 67B, from where it will be pushed out centrifugally towards and beyond the bed of needles of the semicircle of needles that produced the toe pouch SP. The elements 65, 65A and 67, 67A are arranged in pairs and move forwards and backwards (under the control of the actuators 55A, 55B) in alternation so that one of them is always keeping the fabric in the advanced position out beyond the circle of needles (FIG. 10). The purpose of the parts 65, 65B, 65A and 67, 67B, 67A is in this way to progressively engage the fabric of the free end portion L, containing the elastic courses RE, beginning with the end L1 (FIG. 6), and pass it out beyond the needles 9 of the pouch region SP. These needles up to this point have all been hooked on the sliders 7 of the top cylinder 3 and in the raised position, as shown in FIGS. 3 and 9.

Figure 9:
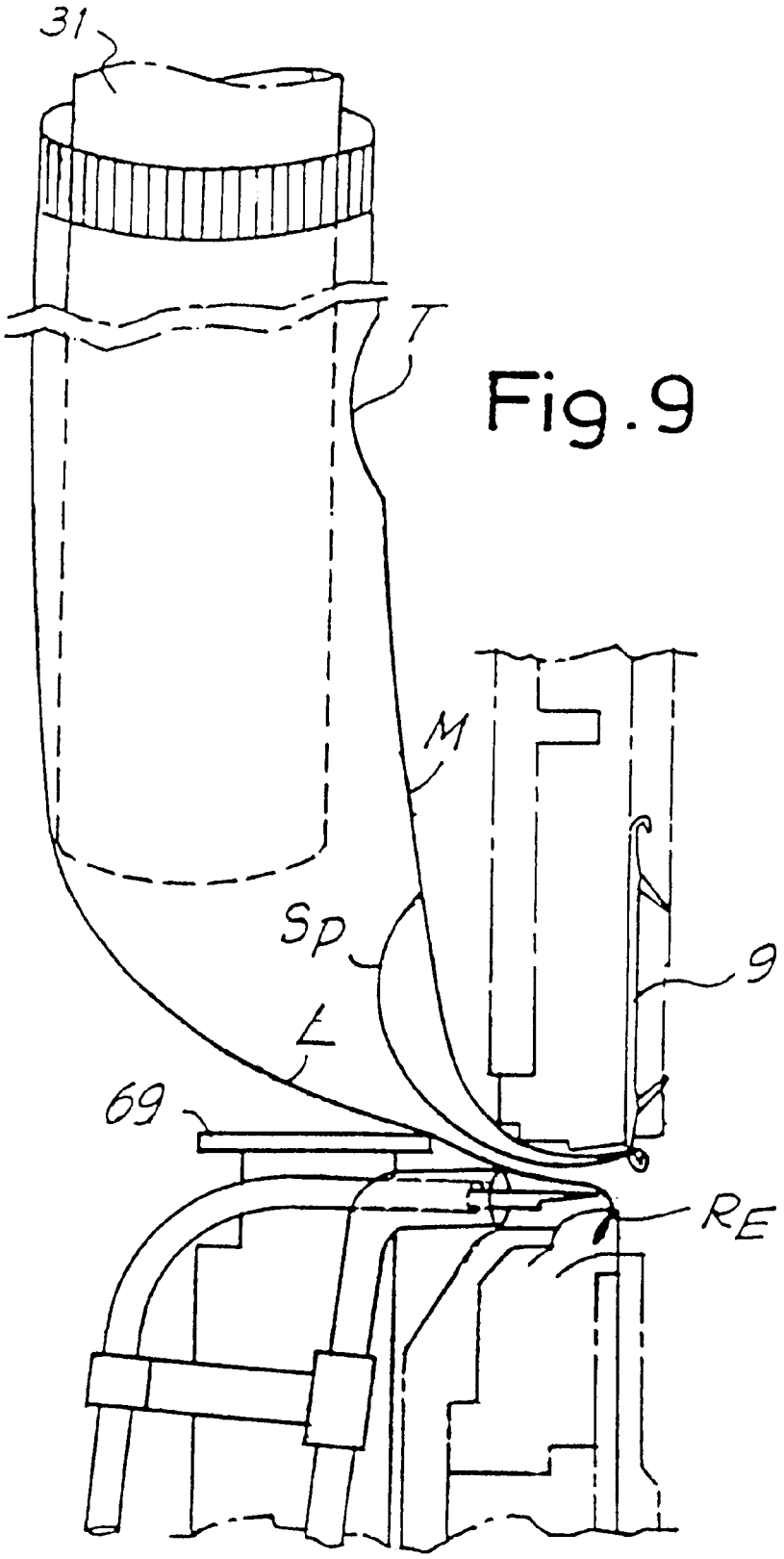
FIGS. 9 to 15 are veiws in isolation of the article being formed and some of the parts of the machine, in a number of successive stages of the cycle of forming and closing the toe of an article.
Figure 10:
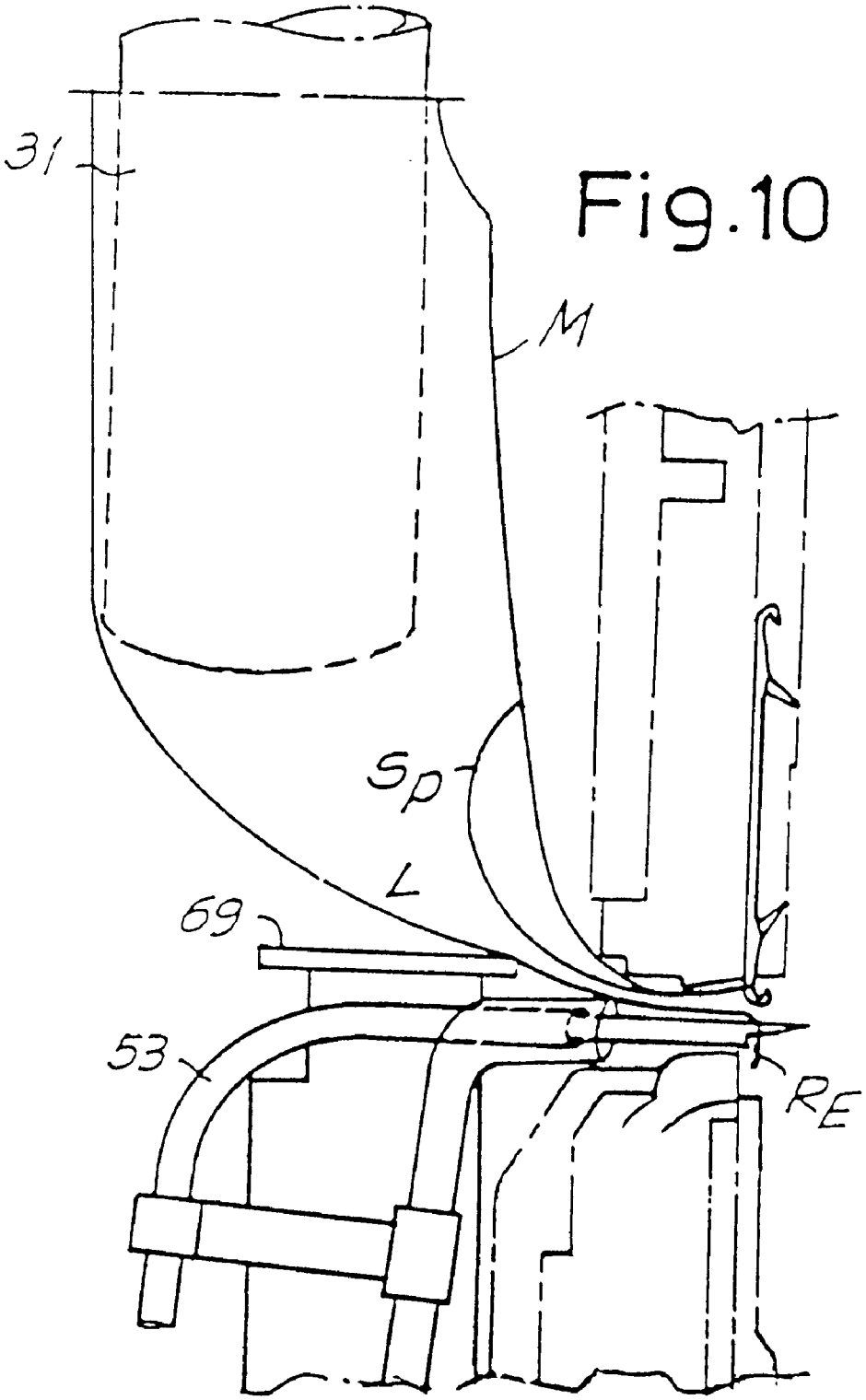
Figure 11:
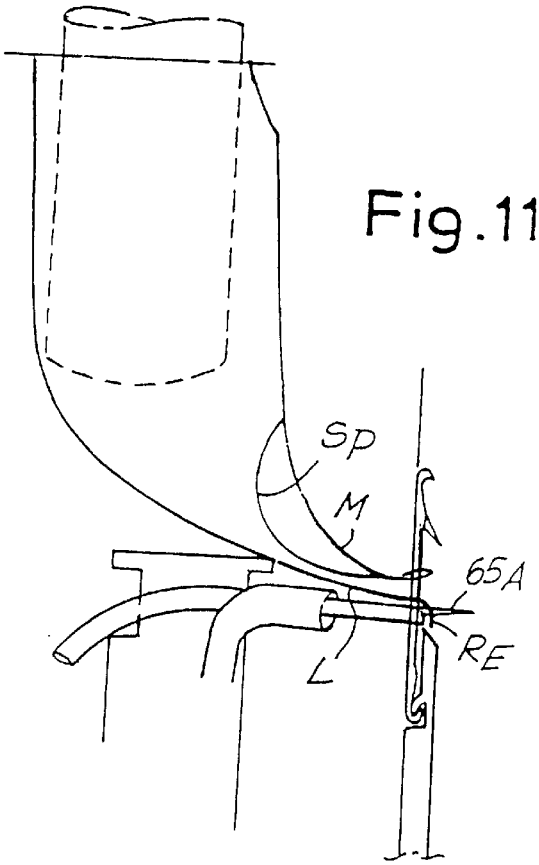
Figure 12:
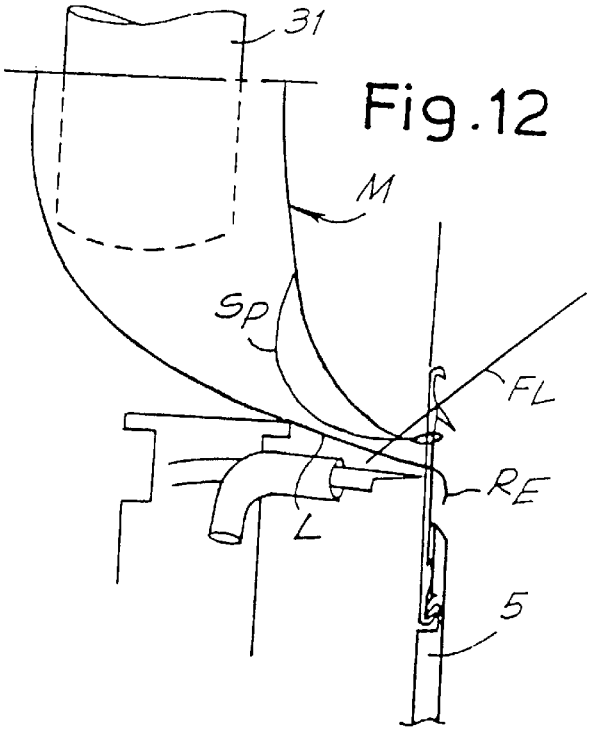
Figure 13:
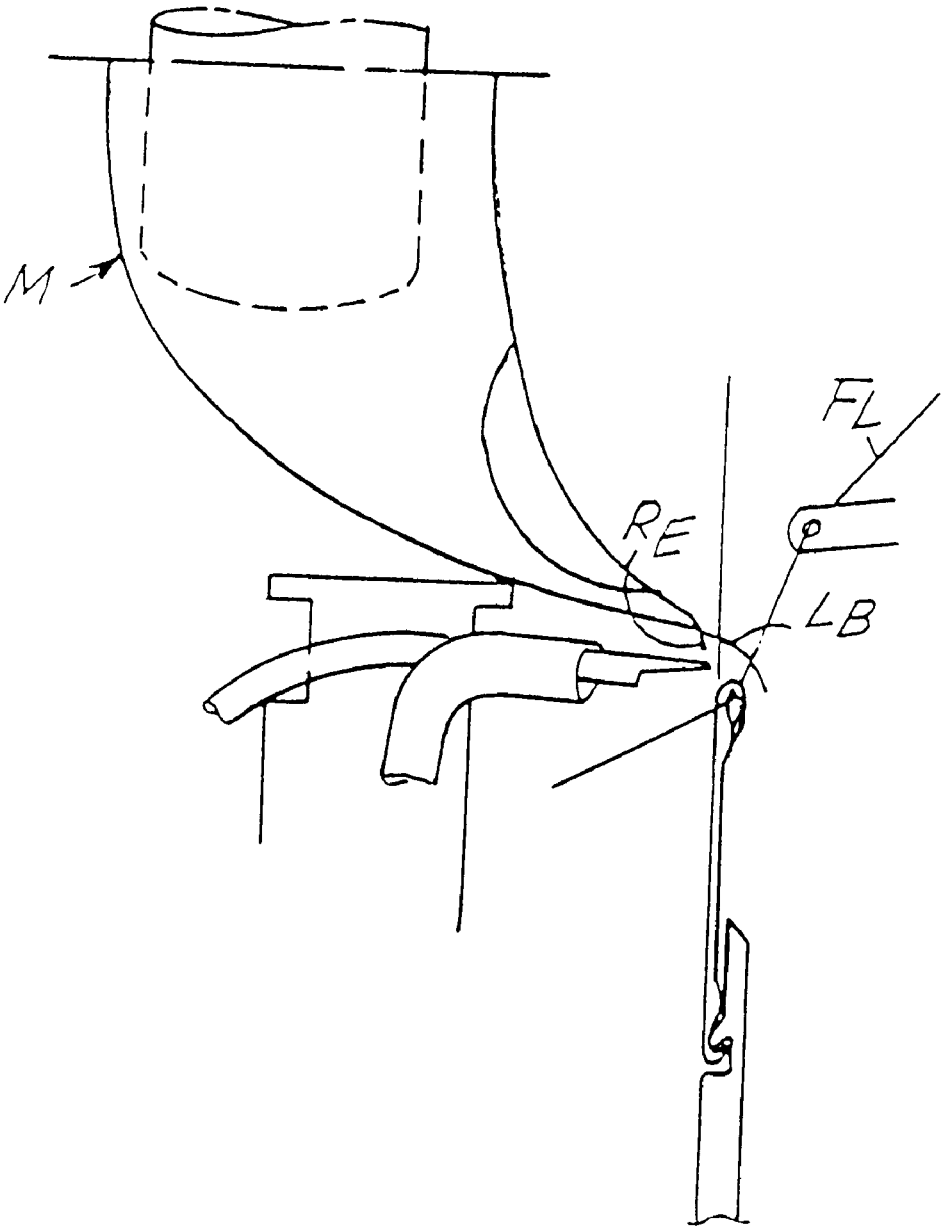

As the fabric L of the elastic edge RE is pushed outwards, the needles 9 are progressively lowered in the vicinity of the points 65A and 67A as in FIGS. 11, 12, thereby perforating the fabric L and retaining it on their stems, which are already carrying the loops of the side of fabric that includes the pouches T and SP (FIGS. 9, 10, 11). The needles 9 continue their descent until hooked on the sliders 5 of the bottom cylinder 1 (FIG. 12). During this descent, the needles 9 are fed with a tying yarn FL (FIG. 12) and thus form with the pushing down of the two combined end portions a course of stitches that connects them together (FIG. 13). The operation of closure—continues with reciprocating motion with a few more partial courses of stitches that cannot be unraveled, in such a manner as to create a lip LB (FIG. 13). The courses of stitches for the closure and for the lip LB are made with reciprocating motion of the cylinders and produced only on that half of the needles that formed the pouches T and SP and are now carrying the two combined end portions of fabric. After this, the feed yarn is removed from the feeder that produced the lip LB, with the result that the article M of the stocking now already has a closed toe and is unattached and positioned around the outside of the tube 31, which until now has remained inactive, that is without suction.

Figure 14:
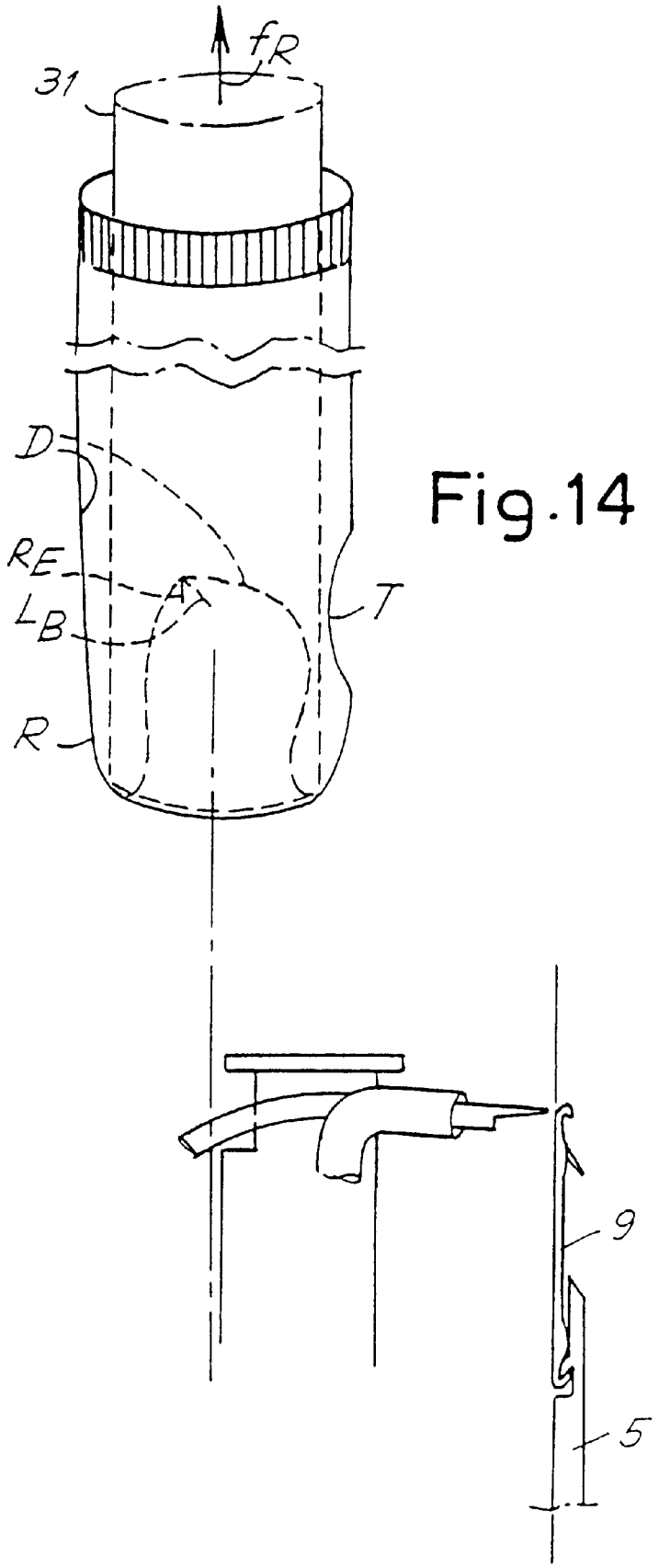
Figure 15:
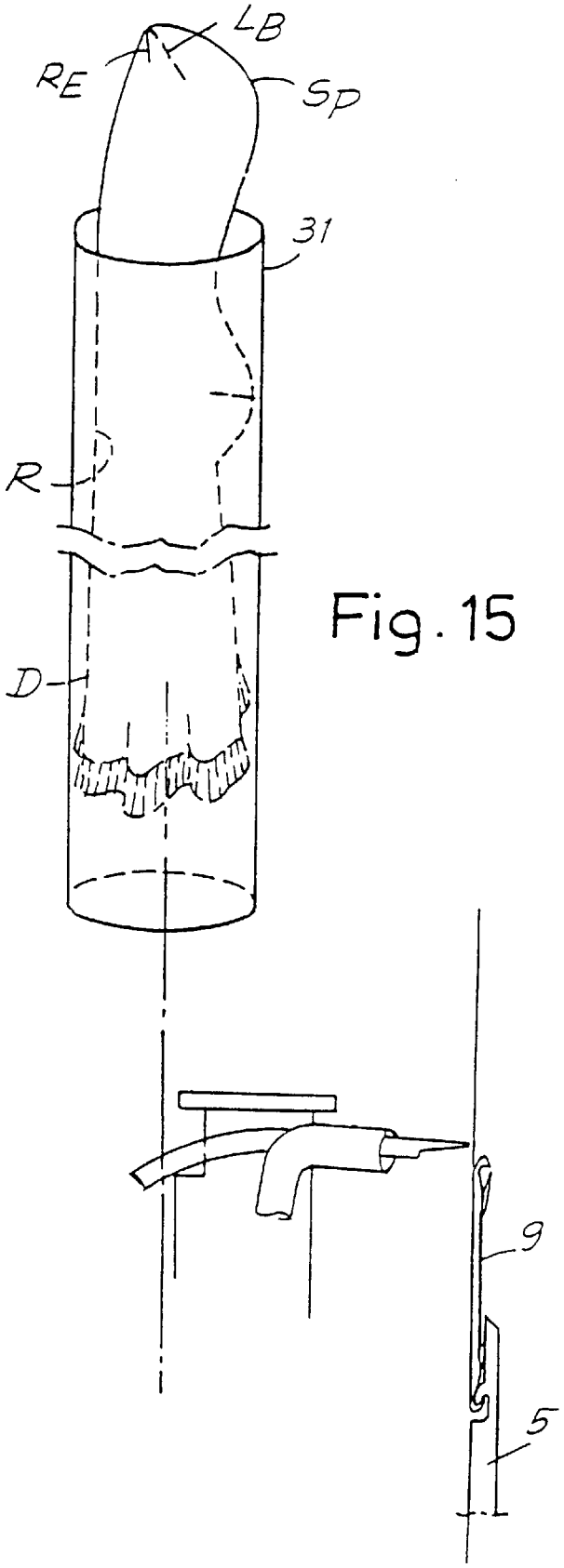

When the final lip LB is completely unattached, a baffle in the suction duct—or some other means—is used to interrupt the suction in the duct 33, 33A and divert it to the duct 31, as shown by the arrow fR in FIG. 14. The effect of this is to suck the stocking in from the closed toe end, which, as it enters the tube 31 will turn the article the right way round so that its face side D is on the outside and its reverse side R on the inside, while the casting-off lip LB is now on the inside of the stocking, greatly improving the appearance of the article. The commencement of the operation of turning the stocking inside out is shown in FIG. 14, where the toe of the stocking can be seen just entering the tube 31, while FIG. 15 shows the stocking completely inside out in the tube 31, on its way out of the machine.

The above account will have shown that in a double-cylinder stocking machine it is possible to close the final end of the tubular article M, which may be produced with a toe pouch SP made with reciprocating movement of the cylinder. After being produced, the stocking is completely turned inside out by means of the suction through the duct 31 in the top cylinder so that the garment has its face D on the outside and its closing lip LB on the inside, all brought about by the process of pneumatic removal. The closing of the toe is performed on the finished and still open garment while it is still on the needles, after a few courses have been produced with elastic yarn on the half cylinder corresponding to the instep, before all the needles are transferred into the top cylinder and the stitch loops are cast off the needles of the half cylinder corresponding to the instep. The mechanical device located inside the bottom cylinder, which does not rotate with this cylinder and is fitted with suitable actuators, is able to engage the end portion of knitted fabric L from the first half of the cylinder to be abandoned, and bring it—by means of the plate 69 or the like—progressively towards the opposite side of the circle of needles. Other elements of this mechanical device inside the bottom cylinder secure this end portion L as it reaches the needles and gradually pushes the fabric of this end portion L out beyond the circle of the needles; this operation takes place close to the point where the needles are transferred, which means it is possible to transfer them from the top cylinder to the bottom cylinder in such a way that they pass through the fabric of the end portion L as it is held out by the abovementioned means. The needles 9 transferred to the bottom will thus be carrying the loops they had previously, plus the periphery of the end portion L of fabric through which they have passed. The final lip LB of unrovable fabric is then formed on the half cylinder carrying both sides of the stocking, before the complete garment is cast off from the needles.

The reversal of the flow of suction from the outer tube 32 to the inner tube 31 turns the stocking inside out and expels it through the tube 31, leaving the casting-off lip LB on its inside.

It will be understood that the drawings shows only an example purely as a practical demonstration of the invention, which invention may be varied as regards shapes and arrangements without thereby departing from the scope of the concept underlying said invention. In particular, the end portion L corresponding to the instep—which is released by the needles—can be transferred across to the needles of the other half of the cylinder with the aid of the means differing from those of the assembly contained within the bottom cylinder 1, with known devices, such as, for example, those described in earlier intellectual property documents indicated for single-cylinder machines, including patent applications by the present proprietor No. FI 94 A 88 of 17.05.1994 and, PCT/IT/00072 (WO95/31595) corresponding to U.S. Pat. No. 5,647,229 and No. FI 94 A 125 of 16.06.1994, PCT/IT/9500099 of 07.06.1995 (W095/34702) corresponding to U.S. Pat. No. 5,617,744.

I claim:

1. Method for forming a tubular article with a closed end and with rib fabric having a face and a reverse, the method comprising the steps of:

providing a circular machine with two needle beds having needles forming a first semicircle and a second semicircle;

knitting the tubular article with said needles of said circular machine to form a first fabric portion knitted by said needles of said first semicircle and to form a second fabric portion knitted by said needles of said second semicircle;

transferring said first fabric portion to said second fabric portion;

engaging said first fabric portion on said needles of said second semicircle to close an end of the tubular article;

removing the closed tubular article from said circular machine.

2. A method in accordance with claim 1, wherein:

said circular machine includes two cylinders;

said first semicircle is opposite said second semicircle.

3. A method in accordance with claim 1, further comprising:

providing a pneumatic transport tube;

tensioning the tubular article in a first direction around said pneumatic transport tube;

turning the tubular article inside out and upside down in said pneumatic transport tube after the tubular article has been closed.

4. A method in accordance with claim 1, wherein:

said circular machine includes a needle cylinder;

said knitting of said first fabric portion uses an elastic yarn;

said elastic yarn is used to arrange said first fabric portion diametrically with respect to said needle cylinder;

said transferring and engaging is performed progressively on said first fabric portion.

5. Double-cylinder circular knitting machine, comprising:

first and second cylinders;

a plurality of needles transferable between said first and second cylinders and forming a first semicircle and a second semicircle;

sliders slidable in each said cylinder to operate said needles and form a first fabric portion by said needles of said first semicircle and form a second fabric portion by said needles of said second semicircle;

transfer means for moving said first fabric portion toward said needles of said second semicircle;

engaging means for operating said needles of said second semicircle to engage said first fabric portion when said first fabric portion is moved to said needles of said second semicircle.

6. A knitting machine in accordance with claim 1, further comprising a yarn feeder guide feeding elastic yarn to said needles of said first semicircle to form final stitches of said first fabric portion with the elastic yarn;

said transfer means progressively transferring said final stitches of said first fabric portion to said needles of said second semicircle;

a plurality of pushers further moving said first fabric portion in a radially outward direction to intercept a path of said needles of said second semicircle.

7. A knitting machine in accordance with claim 1, wherein:

a closure mechanism positioned inside one of said cylinders, said one cylinder being rotatable separately from said closure mechanism, said closure mechanism including a shaped plate progressively pushing said first fabric portion to said second semicircle of said needles, said closure mechanism including a plurality of pushers further pushing said first fabric portion in a radially outward direction to intercept a path of said needles of said second semicircle, said closure means including means for reciprocating said pushers.

8. A knitting machine in accordance with claim 1, further comprising:

a pneumatic transport duct coaxial with one of said cylinders for pneumatic removal of the article;

a tensioning duct having an annular section arranged around said transport duct and for tensioning the article during formation of the tubular article.

9. A knitting machine in accordance with claim 8, further comprising:

control means for stopping suction through said tensioning duct and starting suction in said transport duct to turn the article inside out and remove the article.

* * * * *